US007585125B2

(12) United States Patent
Mühlhausen et al.

(10) Patent No.: US 7,585,125 B2
(45) Date of Patent: Sep. 8, 2009

(54) DEVICE FOR STORING AND DISPENSING A FLOWABLE PRODUCT

(75) Inventors: Hans Georg Mühlhausen, Düsseldorf (DE); Markus Nachtsheim, Bonn (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 666 days.

(21) Appl. No.: 11/356,858

(22) Filed: Feb. 17, 2006

(65) Prior Publication Data

US 2006/0157514 A1 Jul. 20, 2006

Related U.S. Application Data

(63) Continuation of application No. PCT/EP2004/008769, filed on Aug. 5, 2004.

(30) Foreign Application Priority Data

Aug. 18, 2003 (DE) ..... 103 37 835

(51) Int. Cl.
*A46B 11/00* (2006.01)

(52) U.S. Cl. ..... 401/125; 401/123

(58) Field of Classification Search ..... 401/118, 401/123, 124, 125, 202, 204, 205, 207
See application file for complete search history.

(56) References Cited

U.S. PATENT DOCUMENTS

| | | | | |
|---|---|---|---|---|
| 1,903,312 | A | 4/1933 | Ellis | |
| 1,942,953 | A | 1/1934 | Bennett | |
| 2,204,784 | A | 6/1940 | Abrams | |
| 3,223,096 | A * | 12/1965 | Goldberg et al. | 15/104.94 |
| 6,321,937 | B1 * | 11/2001 | DeSimone et al. | 221/45 |
| 7,114,871 | B2 * | 10/2006 | Thiebaut | 401/205 |

FOREIGN PATENT DOCUMENTS

| | | |
|---|---|---|
| EP | 0 024 756 | 3/1981 |
| EP | 0 671 340 | 9/1995 |

* cited by examiner

*Primary Examiner*—David J Walczak
(74) *Attorney, Agent, or Firm*—David P. LeCroy

(57) ABSTRACT

A device for storing and dispensing a flowable product, for example a liquid cleaning or care product. The device includes a product container for the flowable product having at least one closable dispensing opening. The product container is connected detachably to an open-topped receiving container in which a large number of plate-shaped or cloth porous elements are accommodated one on top of another, the product container being provided on the outer side facing the receiving container with a fastener for detachably attaching a porous element to the bottom of the product container.

8 Claims, 5 Drawing Sheets

DEVICE FOR STORING AND DISPENSING A FLOWABLE PRODUCT

CROSS REFERENCE TO RELATED APPLICATIONS

This application is a §365(c) continuation application of PCT/EP04/08769 filed Aug. 5, 2004, which in turn claims priority to DE Application 103 37 835.9 filed Aug. 18, 2003, each of the foregoing applications being incorporated herein by reference.

FIELD OF THE INVENTION

The invention relates to a device for storing and dispensing a flowable product, for example a liquid cleaning or care product, with a product container for the flowable product, which comprises at least one closable dispensing opening, and a method of using it.

BACKGROUND OF THE INVENTION

Devices of this kind are known in very different forms. They serve for example for storing and dispensing a flowable cleaning product which may be a liquid or a gel, or may be a granular or pulverulent product. When the device is used, product is usually dispensed by exerting pressure on the product container after the dispensing opening has been opened, either directly onto the surface to be cleaned or onto a cleaning rag or a cleaning cloth. This kind of handling is customary and can also be carried out easily as part of normal household cleaning. Often, however, it is necessary in the meantime to clean a table top or the like, for example. In such a case, it is inconvenient to proceed in the way described above as the user requires not only the product container but also a porous element such as a rag, a cloth, a sponge or the like and these elements are not usually stored in direct proximity to the surface to be cleaned.

SUMMARY OF THE INVENTION

It is an object of the invention to provide a device which is ready for use directly without additional elements and can be stowed close to the object to be treated.

According to the invention, this object is achieved in a device of the kind described by virtue of the fact that the product container is connected detachably to an open-topped receiving container in which a large number of plate-shaped or cloth-shaped porous elements are accommodated, preferably in a stack one on top of another, the product container being provided on an outer side facing the receiving container with a fastening means for detachably attaching a porous element which may absorb or be impregnated with the flowable products. The fastening means may consist of a male fastener on the product container and cooperating female fasteners on the porous elements.

This device consequently comprises in addition to the actual container a storage space for block-like or cloth porous elements which are immediately available in the device itself. In this connection, the porous element arranged in the uppermost layer of the open-topped receiving container adheres to the confronting outer side of the product container. During the cleaning operation, product is first in the usual way applied to the surface to be cleaned, for example by applying pressure to a dispenser mounted to the product container, or to the container itself (if it is a soft plastic bottle). The product container is then detached from the receiving container, and a porous element, with which the cleaning product can be spread over the surface to be cleaned, adheres to the outer side of the product container confronting the receiving container. Depending on the degree of soiling after the cleaning operation, the porous element remains adhered to the outer side of the product container or is removed by the user and disposed of. The product container is then inserted into the receiving container again. When next used, that is after the product container has been removed from the receiving container, the already used porous element still adheres to the product container or, if it was removed after the last cleaning operation, the next porous element adheres automatically as it came into contact with the fastening means on the outer side of the product container when the product container was inserted into the receiving container. For particularly difficult surfaces to be cleaned, the porous element may be removed from the releasable fastener and used with or without additional cleansing product dispensed onto the surface or onto the porous product from the product container.

In a preferred development, the fastening means is provided on the lower side of the product container. The product container is then put with the lower side into the open-topped receiving container, and the receiving container serves at the same time as a standing foot for the device.

The fastening means is preferably designed in the style of a touch and close fastener. A common touch and close fastener is a hook-and-loop fastener where flexible hooks are mounted on the product container and loops are provided on the exposed surface of the porous element, for example by fleece. The touch and close fastening means can of course be formed in other ways, for example by a suitable adhesive coating. It can also be designed as a snap fastener if the porous element is sufficiently stable. This is the case, for example, if it is made of felt. The device can then be used for furniture care, for example.

In order for it to be possible to handle the device easily when not in use, the product container can preferably be inserted into the receiving container.

In this connection, cooperating catch means are preferably provided on the product container and on the receiving container. The catch means can then be designed in such a way that different catching positions are provided, that is the product container can be inserted into the receiving container to different depths depending on the filling level of the receiving container with more or fewer porous elements. Alternatively, it is also possible to provide only one catching position, in which case it is advantageous if the bottom surface of the receiving container is, for example, designed to be displaceable in a spring-loaded manner in such a way that it is ensured that the uppermost layer of the porous elements is always located at such a vertical level in the receiving container that the product container, or its facing outer side with the fastening means, comes into contact with the uppermost porous element.

A further preferred constructional development is distinguished by the fact that the product container is on the lower side connected detachably to a bottom plate, on the lower side of which the fastening means is arranged. In this development, the product container can be exchanged easily when it no longer contains any liquid product. However, it goes without saying that in principle the product container can also comprise a refilling opening.

BRIEF DESCRIPTION OF THE DRAWINGS

The invention is explained in greater detail below by way of example with reference to the drawing, in which.

DESCRIPTION OF THE PREFERRED EMBODIMENTS

Figure 1:
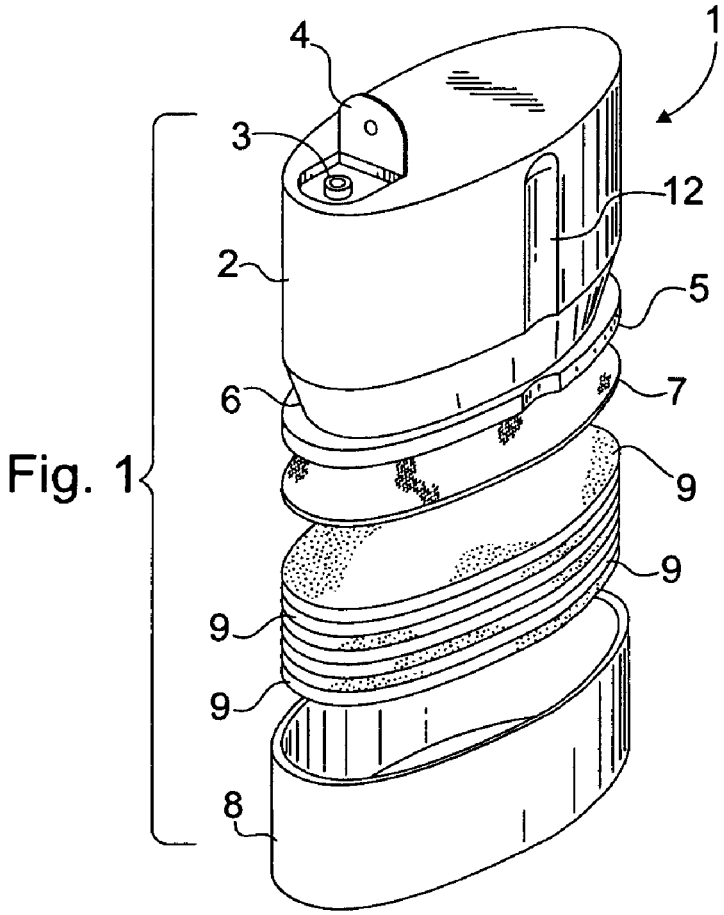
FIG. 1 shows an exploded illustration of a first embodiment of a device made according to the invention.

The first embodiment of a device according to the invention for accommodating and dispensing a flowable product is designated generally by 1. The device 1 comprises first a product container 2 which is provided on the top side with at least one dispensing opening 3 and a closure cap 4. The lateral wall surfaces are preferably designed in such a way that they can be pressed in easily in order to facilitate the dispensing of product through the dispensing opening 3. The walls may be of soft plastic, or the closure may be provided with a pressure-responsive pump. A fastening means, which is of two-part design in the illustrative embodiment, is provided on the lower side on the product container 2. In the embodiment illustrated, this fastening means comprises a bottom plate 5 which can be pushed onto a tapered or grooved projection 6 on the lower side of the product container so as to catch. The bottom plate 5 serves for the attachment of a strip 7 of flexible hooks or the like, which is glued to the bottom plate 5, for example.

The device 1 also comprises an open-topped receiving container 8 in which a large number of porous elements 9, which, in this embodiment, are in the form of fleece cloths, are stacked one on top of another. The strip 7 is designed in such a way that the uppermost porous element 9 adheres to it.

Figure 2:
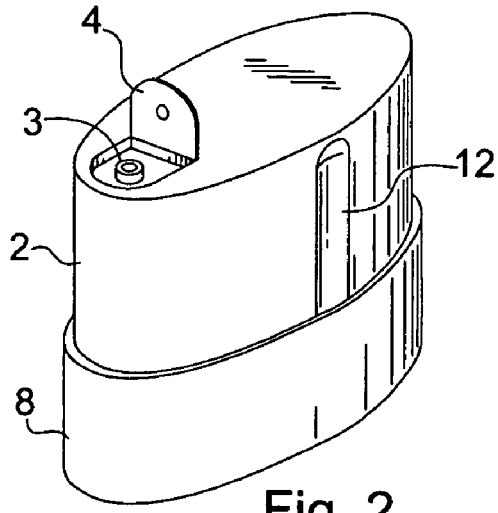
FIG. 2 shows a perspective illustration of the embodiment of FIG. 1 in the assembled state.
Figure 3:
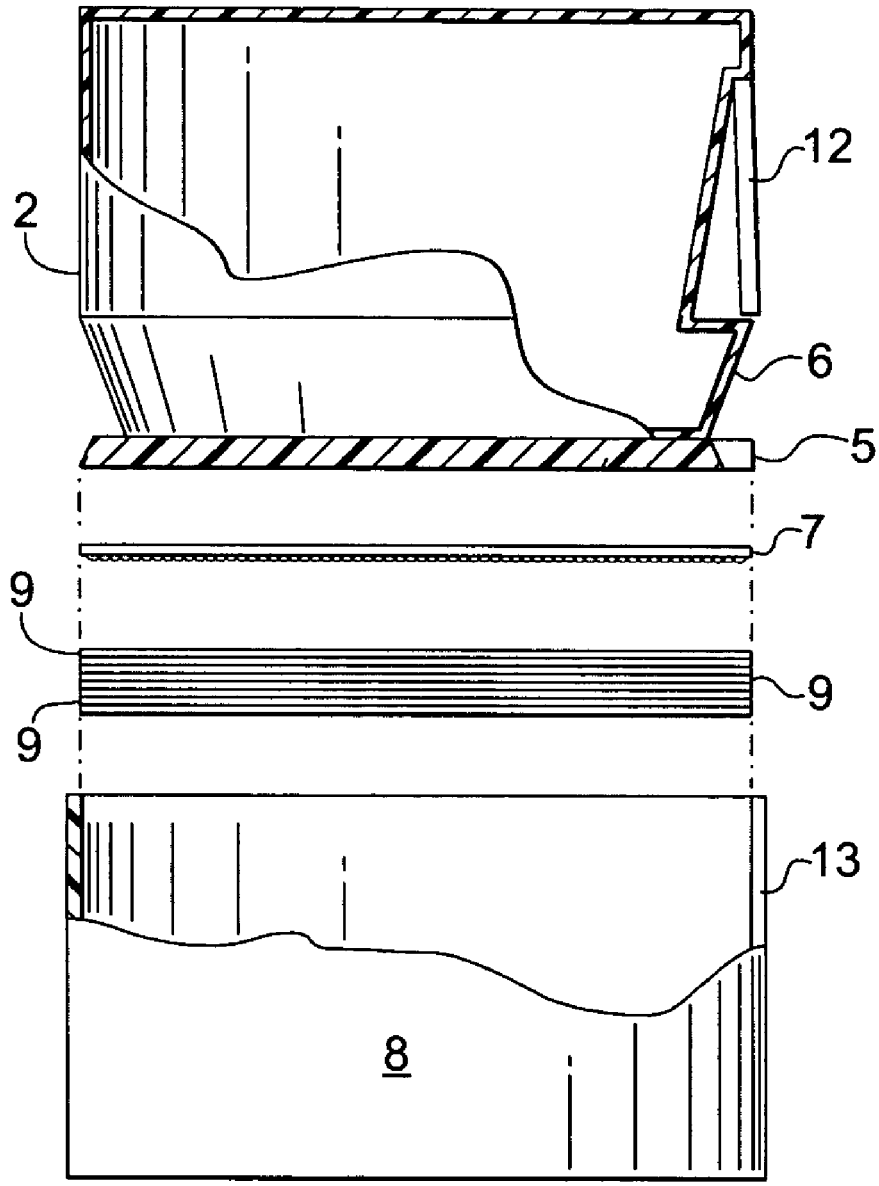
FIG. 3 is an elevational view of the device of FIG. 1 with portions broken away.

In the closed state of the device 1 as shown in FIG. 2, the product container 2 is telescopically inserted into the open-topped receiving container 8. In this connection, catch means 12 and 13 (shown schematically in FIG. 3) are preferably provided between the two containers in order that the device 1 can in the state shown in FIG. 2 be handled as a single part, for example can be put down on the table top.

To clean a table top or the like, the closure cap 4 is opened and product is dispensed from the dispensing opening 3, for example by pressing on the walls, preferably side walls, of the product container 2 or by means of a pump device (not illustrated) on the product container 2. Then, the closure cap 4 is preferably closed again and the product container 2 is pulled out of the receiving container 8. In this connection, the uppermost porous element 9 adheres to the fastening means, in the present embodiment the strip 7, on the lower side of the product container 2. The product container 2 is put over the dispensed cleaning product with the porous element 9 adhering to it on the lower side, and the cleaning product is spread over the table top or the like for cleaning the same.

Depending on the degree of soiling, either the product container 2 can then be put back into the receiving container 8 with the porous element 9 attached to it or, if the porous element 9 adhering on the lower side is too heavily soiled, it is removed from the lower side of the product container 2 and disposed of by the user, and the product container 2 is then put back into the receiving container 8. In the process, the uppermost porous element 9 in the receiving container 8 adheres automatically to the lower side of the product container 2, so that a porous element 9 is again available on the lower side of the product container 2 after the product container 2 is removed from the receiving container 8 when next used.

Figure 4:
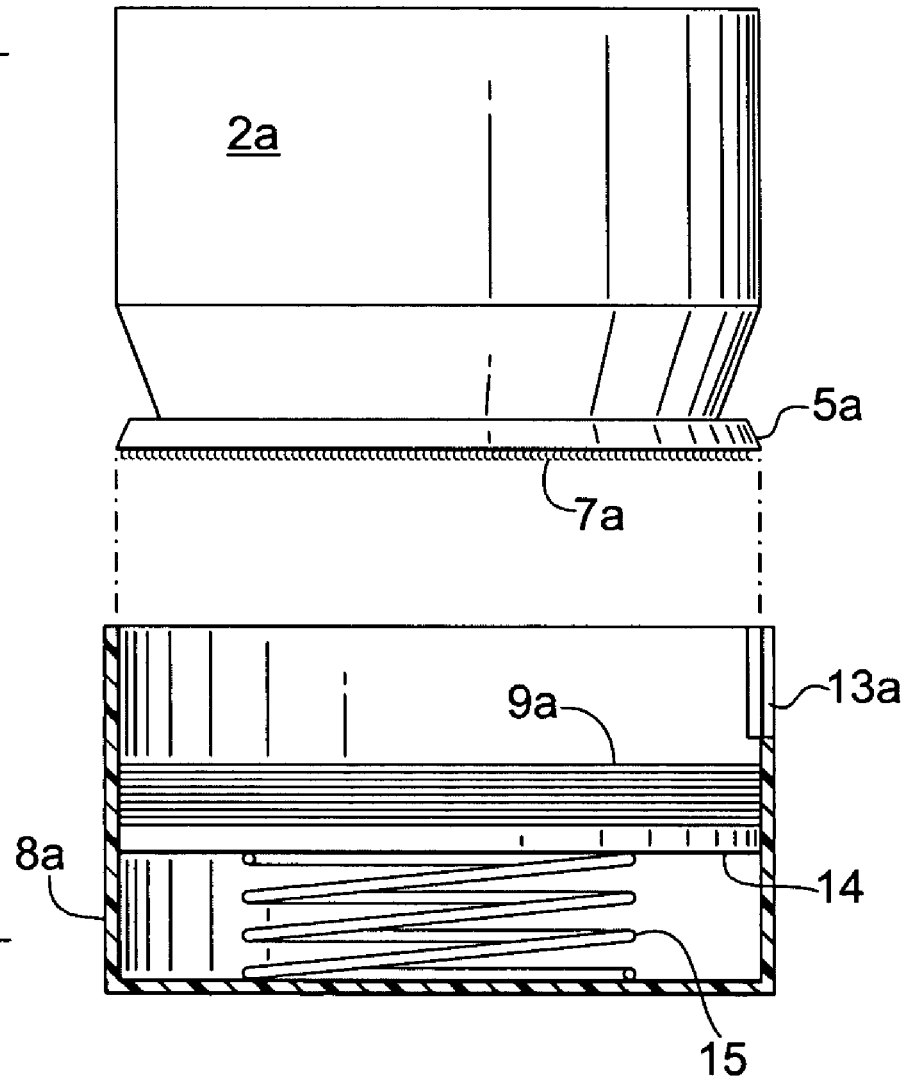
FIG. 4 is a sectional view similar to FIG. 3 of a second embodiment of the invention.

A second embodiment of the invention is illustrated in FIG. 4. In this embodiment of the invention, a product container 2*a* has a bottom plate 5*a* secured to its tapered bottom. The bottom plate 5*a* is provided with releasable fasteners 7*a* which are adapted to cooperate with the porous cleaning elements 9*a* stored in the open-topped receiving container 8*a*. In the present instance, the porous elements 9*a* comprise thin sponges. In this embodiment, a catch means 13*a* latches the product container 2*a* into the top of the receiving container 8*a*. The receiving container 8*a* has a false bottom 14 which is biased upwardly in the container 8*a* by an underlying spring element 15. The false bottom 14 urges the cleaning elements 9*a* upwardly to the top of the receiving container 8*a* where the uppermost element may be engaged by the fastener 7*a*.

Figure 5:
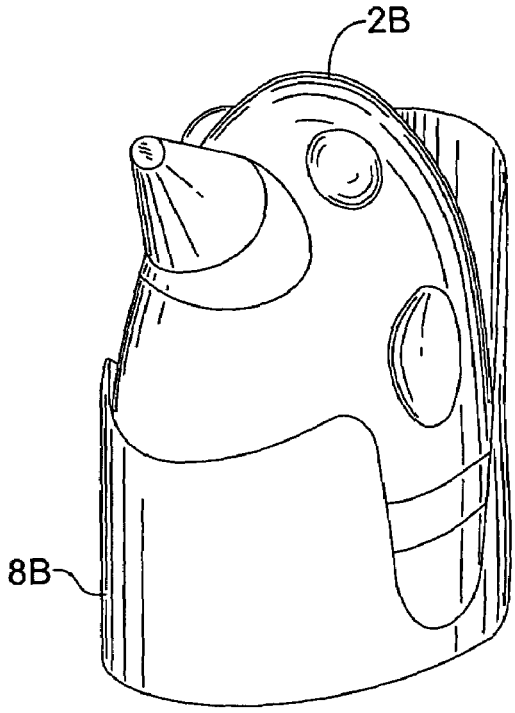
FIG. 5 is a diagrammatic perspective view of a third embodiment of the invention.
Figure 6:
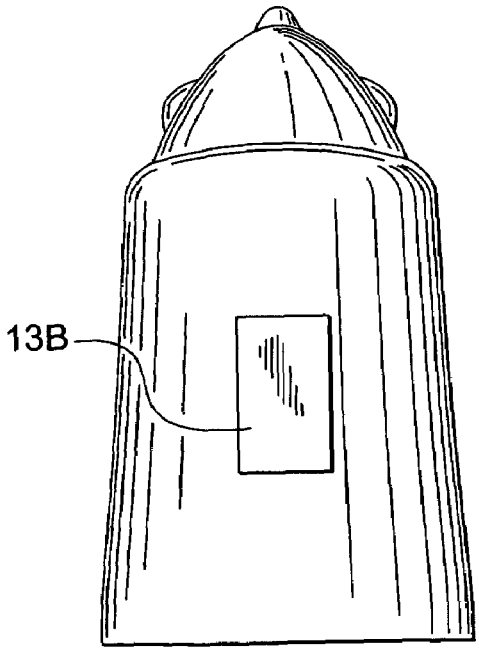
FIG. 6 is a rear elevation of the embodiment shown in FIG. 5.
Figure 7:
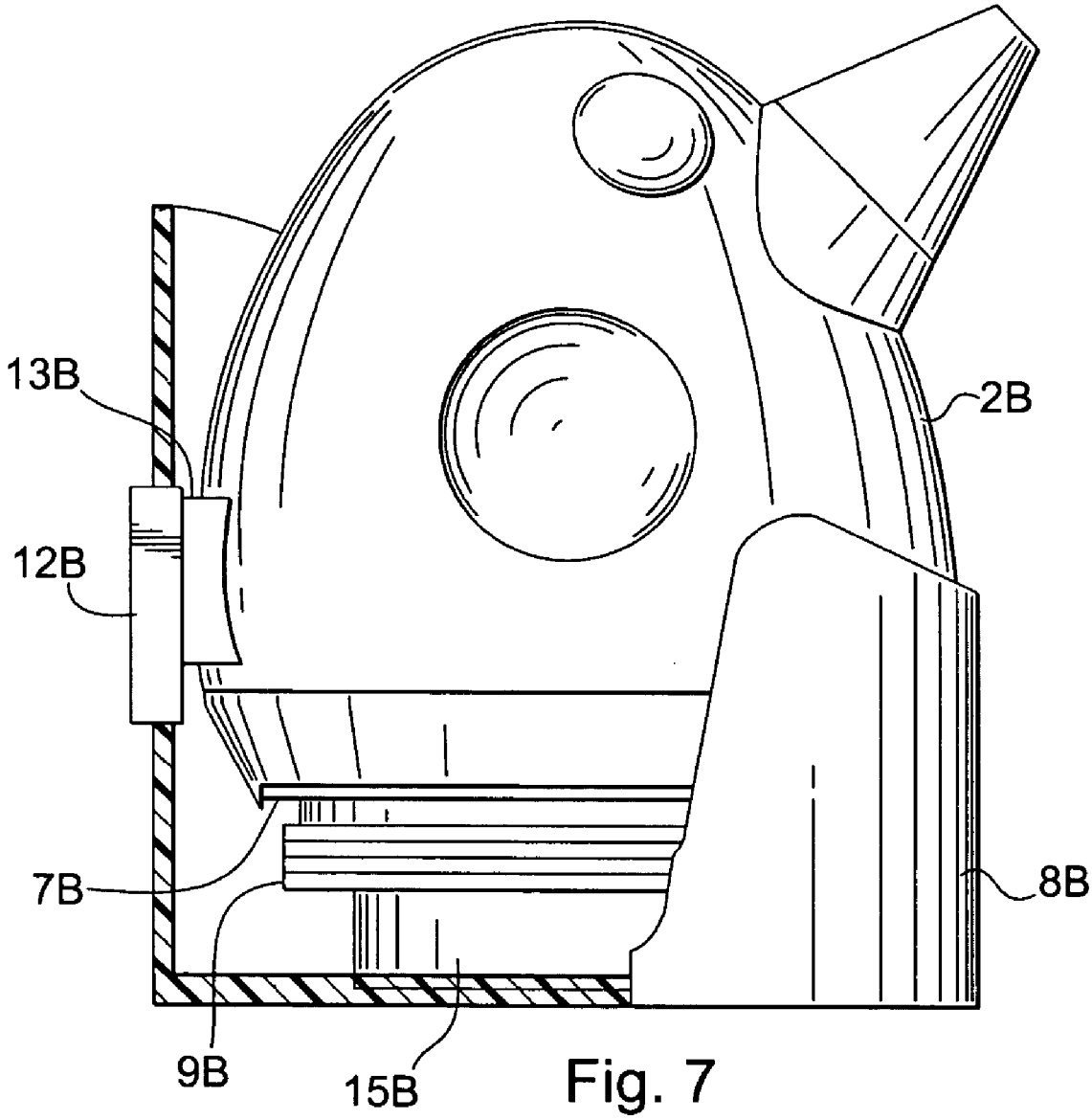
FIG. 7 is a side elevation of the embodiment shown in FIG. 5 with portions broken away.

A third embodiment is illustrated in FIGS. 5-7 inclusive. The third embodiment comprises a decorative product container 2B which is adapted to be telescopically engaged in a receiving container 8*b*. In the present instance, the back of the container has a latch element 13B (FIGS. 6 and 7) which cooperates with a keeper element 12B (FIG. 7). In this embodiment, a fastener element 7B is mounted on the bottom of the product container 2(*b*) and is designed to releasably engage the uppermost porous element 9B in the stack which is stored in the bottom of the receiving container 8B. A compressible support element 15B underlies the stack of porous elements 9B to urge the stack upwardly against the bottom of the product container 2B.

The invention is of course not limited to the illustrative embodiments shown. Other developments are possible without departing from the basic idea. For instance, a bottom plate is not absolutely essential. The touch and close strip or another suitable fastening means can also be attached directly to the lower side of the product container 2. However, the variant with a bottom plate 5 illustrated affords the additional advantage that the product container 2 can be produced very inexpensively and designed as a disposable and exchangeable article, that is it can be replaced by a correspondingly designed full product container 2 when it has been completely emptied. Additionally or alternatively, the product container 2 can of course also comprise a refilling opening (not illustrated). The porous elements 9 can also be designed as felt plates which can with a cutout engage serving as a female component to catch a male headed element serving as a fastening means on the bottom plate 5. The device can then also be used for furniture care, for example. Use of the device for flowable cosmetics, for example make up, is also possible.

The invention claimed is:

1. A device for storing and dispensing a flowable product, comprising a product container for the flowable product, said container having at least one dispensing opening for the flowable product at an upper end of the product container, an open-topped receiving container, and a stack of porous elements in said receiving container, the lower end of the product container having fastening means for detachably attaching a porous element from the top of said stack, with the lower end of the product container being removably connected to the open-topped receiving container, and with cooperating catch means on the product container and on the receiving container to releasably maintain said product and receiving containers engaged.

2. The device as claimed in claim 1 wherein said fastening means is a hook and loop fastener.

3. The device as claimed in claim 1 wherein the product container is adapted to telescopically fit into the receiving container.

4. The device as claimed in claim 1 wherein said product container has a tapered lower extremity.

5. The device of claim 1, wherein the cooperating catch means releasably maintains the product container and receiving container telescopically engaged.

6. The device of claim 1, including an openable closure cap covering the dispensing opening of the product container.

7. The device of claim 1, wherein said fastening means is a hook and loop fastener, wherein the product container is adapted to telescopically fit into the receiving container, wherein said product container has a tapered lower extremity, wherein the cooperating catch means releasably maintains the product container and receiving container telescopically engaged, including an openable closure cap covering the dispensing opening of the product container.

8. The device as claimed in claim 1, wherein the product container has side walls that are sufficiently flexible that they can be pressed in easily for dispensing of product through the dispensing opening.

* * * * *